US006478197B2

(12) United States Patent
Bethune et al.

(10) Patent No.: US 6,478,197 B2
(45) Date of Patent: Nov. 12, 2002

(54) SPRING-EFFECT PUSHBUTTON

(75) Inventors: Alain Bethune, Savigny (FR); Guilhem Rousselet, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/816,732

(22) Filed: Mar. 22, 2001

(65) Prior Publication Data

US 2001/0054626 A1 Dec. 27, 2001

(30) Foreign Application Priority Data

Mar. 31, 2000 (FR) ..... 00 04125

(51) Int. Cl.[7] ..... B65D 88/54
(52) U.S. Cl. ..... 222/340; 222/321.7
(58) Field of Search ..... 222/108, 207, 222/340, 341, 321.7, 321.9, 321.1

(56) References Cited

U.S. PATENT DOCUMENTS 4,034,427 A * 7/1977 Breznock et al. ..... 222/341
4,201,317 A * 5/1980 Aleff ..... 222/207
4,978,035 A * 12/1990 Morane et al. ..... 222/108
5,363,993 A * 11/1994 Mascitelli et al. ..... 222/321.1
5,477,985 A 12/1995 Gueret ..... 222/107
5,687,884 A * 11/1997 Bodin et al. ..... 222/321.7
6,186,369 B1 * 2/2001 Rosenthal ..... 222/321.7

FOREIGN PATENT DOCUMENTS

| | | |
|---|---|---|
| DE | 197 29 516 A1 | 1/1999 |
| EP | 0 863 089 A1 | 9/1998 |
| FR | 2 668 456 | 4/1992 |
| FR | 2 735 452 | 12/1996 |
| WO | WO 96/28257 | 9/1996 |

OTHER PUBLICATIONS

Copy of French Search Report of Nov. 15, 2000.

* cited by examiner

*Primary Examiner*—Lesley D. Morris
*Assistant Examiner*—Thach Bui
(74) *Attorney, Agent, or Firm*—Oppenheimer Wolff & Donnelly LLP

(57) ABSTRACT

A pushbutton for actuating a dispenser member, the dispenser member having a moving element that is movable between two positions, the pushbutton having a base, a head defining both a bearing surface for a user and a dispensing orifice, and an elastically-deformable portion interconnecting the base and the head, the head being suitable for being secured to the moving element. The elastically-deformable portion is arranged so as to deform in the sense of rolling onto itself when the head is depressed and is suitable for returning the moving element into an initial position by resilient return.

81 Claims, 2 Drawing Sheets

SPRING-EFFECT PUSHBUTTON

The present invention relates to the field of devices for packaging and dispensing a liquid or semi-liquid fluid, in particular a cosmetic.

The invention relates more particularly to devices including a manually-actuated pump for dispensing a quantity of fluid.

BACKGROUND OF THE INVENTION

In conventional manner, such pumps comprise a pushbutton defining a bearing surface for the user that is mounted at the top end of a hollow control rod for the pump and that is to be depressed at the time of use.

It is known to use a metal spring to return the pushbutton to its initial position after dispensing a quantity of fluid.

Nevertheless, the use of such a metal spring increases the cost price of the pump and can give rise to problems of corrosion and compatibility with the fluid dispensed.

U.S. Pat. No. 5,363,993 proposes a pump in which the pushbutton is secured to a spring-forming bellows, enabling it to be returned to its initial position after dispensing a quantity of fluid.

Such a bellows is relatively bulky and unattractive in appearance, and it requires a skirt of trim to be provided around it.

In addition, such a bellows is difficult to mold.

OBJECTS AND SUMMARY OF THE INVENTION

The invention seeks in particular to remedy the above-mentioned drawbacks in full or in part.

The invention achieves this by means of a novel pushbutton for actuating a dispenser member, the dispenser member having a moving element that is movable between two positions, the pushbutton having a base, a head defining both a bearing surface for a user and a dispensing orifice, and an elastically-deformable portion interconnecting the base and the head, the head being suitable for being secured to the moving element, and wherein the elastically-deformable portion is arranged so as to deform in the sense of rolling onto itself when the head is depressed and is suitable for returning the moving element into an initial position by resilient return.

The elastically-deformable portion thus deforms in the present invention in a manner different from that of a bellows or a helical spring, since a bellows or a helical spring does not deform in the sense of rolling onto itself, but in the sense of being compacted in an axial direction.

The pushbutton of the invention makes it possible to avoid using a metal spring for returning the pump to its initial configuration after dispensing a quantity of fluid, and to do so without presenting the above-mentioned drawbacks of U.S. Pat. No. 5,363,993.

The pushbutton of the invention is also easily manufactured by molding a plastics material and it can be made to have a shape that is pleasing in appearance, thus making it possible to omit a skirt of trim surrounding the elastically-deformable portion.

In a particular embodiment, the elastically-deformable portion is generally dome-shaped.

The head is preferably situated in the center of the elastically-deformable portion.

Such a configuration makes it possible to facilitate displacement in translation of the head when the user presses against it.

Advantageously, the elastically-deformable portion is arranged to form a fold when the head is depressed, and from at least a certain down stroke of the head, the zone connecting the head to the elastically-deformable portion passes beneath the level of the top of the fold.

In a particular embodiment, the elastically-deformable portion is of substantially constant thickness.

Still in a particular embodiment, the elastically-deformable portion has no folds when at rest.

Such folds could be unattractive in appearance and could encourage the accumulation of dirt.

In a particular embodiment, the base of the pushbutton is tubular in shape, and is preferably circularly symmetrical.

In a particular embodiment, the head includes an endpiece enabling it to be fixed onto a pump control rod.

The endpiece can extend below the level of the coupling zone between the elastically-deformable portion and the head.

In a particular embodiment, the head includes a housing enabling a nozzle to be secured thereto.

The axis of the nozzle may be perpendicular to the direction in which the head is depressed in order to dispense a quantity of fluid, or in a variant it can have some other orientation.

In a particular embodiment, the elastically-deformable portion is connected to the head substantially perpendicularly to the direction in which the head is depressed in order to dispense a quantity of fluid.

Such a configuration makes it possible to cause the elastically-deformable portion to roll onto itself from the beginning of the depression stroke of the head.

In a particular embodiment, the elastically-deformable portion is connected to the head via a zone of reduced thickness.

Such a zone of reduced thickness facilitates moving the head in translation when it is depressed.

Advantageously, the base is arranged to engage on a pump body, in which case it preferably includes an annular bead in the zone used for fixing to the pump body.

Such a bead makes it possible to obtain a stronger clamping force for holding the pushbutton in place on the pump body.

The thickness of the elastically-deformable portion can lie in the range 1 millimeter (mm) to 3 mm, for example, and is preferably close to 2 mm.

In a particular embodiment, the head of the pushbutton has an enlarged top end.

Preferably, the pushbutton is made as a single piece by molding.

The plastics material used for molding the pushbutton can be a material having shape memory, preferably a material selected from mixtures based on the following materials: ethylene vinyl acetate, thermoplastic elastomers, and low density polyethylene.

BRIEF DESCRIPTION OF THE DRAWINGS

Other characteristics and advantages of the invention will appear more clearly on reading the following detailed description of a non-limiting embodiment, and on examining the accompanying drawings, in which.

MORE DETAILED DESCRIPTION

Figure 1:
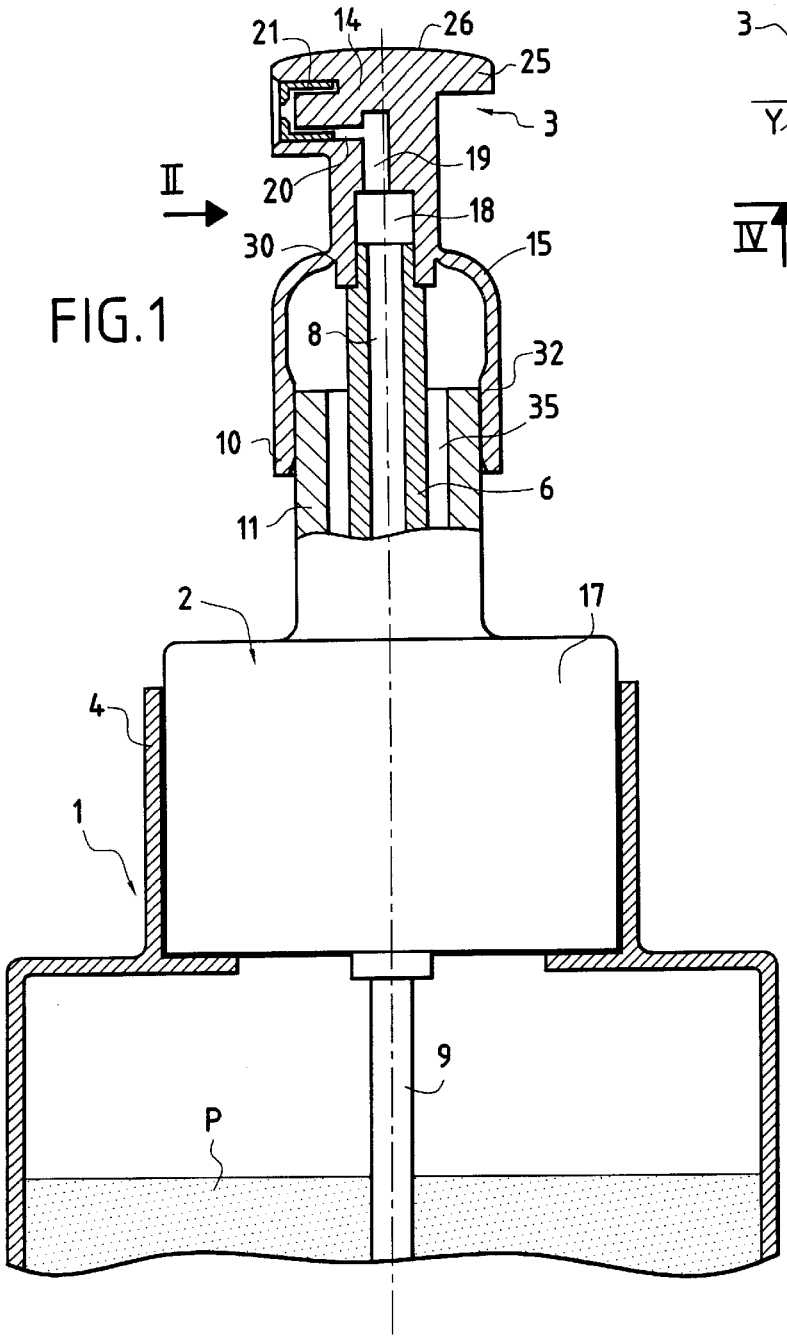
FIG. 1 is a fragmentary and diagrammatic view of a receptacle provided with a pump fitted with a pushbutton of the invention, the pushbutton being shown at rest and in axial section.

FIG. 1 is a fragmentary and highly diagrammatic view of a conventional receptacle 1 provided with a pump 2 fitted with a pushbutton 3 of the invention.

The receptacle 1 is filled with a liquid or semi-liquid fluid P that comes into contact with the body of the receptacle itself in the example described.

In a variant that is not shown the fluid P could be contained in a bag that is capable of collapsing as the fluid is dispensed.

The pump 2 can allow or prevent ingress of air.

The pump comprises a pump body 17 and a hollow rod 6 that is movable in translation along the axis X relative to the pump body 17 so as to move downwardly in order to dispense a quantity of fluid.

The pump body 17 is secured in an assembly skirt 4 formed at the top of the receptacle 1 and it houses, in conventional manner, a suction valve and a delivery valve (not shown in the drawing), co-operating with a piston that is also not shown in the drawing and that is secured to the hollow rod 6 to define a pump chamber of variable volume.

Using a pushbutton 3 of the invention makes it possible to use a pump body 17 that does not have an internal spring, as described in greater detail below.

The above-mentioned delivery valve opens to allow fluid to be dispensed via the internal channel 8 of the hollow rod 6 while the volume of the pump chamber is decreasing, i.e. while the hollow rod 6 is moving downwards, the suction valve then being closed.

When the hollow rod 6 rises, the delivery valve closes and the suction valve opens to enable fluid to penetrate into the pump chamber.

In the embodiment described, the pump 2 is connected to a dip tube 9 enabling the receptacle to be used in a head-up position.

The pushbutton 3 comprises a head 14, a base 10 which is fixed to the top portion 11 of the pump body 17, and an elastically-deformable portion 15 interconnecting the head 14 and the base 10.

The bottom portion of the head 14 has a tubular endpiece 18 on the axis X, into which the top end of the hollow rod 6 is inserted, and the top portion of the head has a housing 20 on an axis Y perpendicular to the axis X for receiving a spray nozzle 21, which nozzle may be constituted merely by an orifice or it may have swirling channels, depending on the nature of the fluid to be dispensed and the purpose thereof.

The inside of the housing 20 communicates with the inside of the endpiece 18 via an internal channel 19 that enables the fluid leaving the hollow rod 6 to be dispensed.

Figure 2:
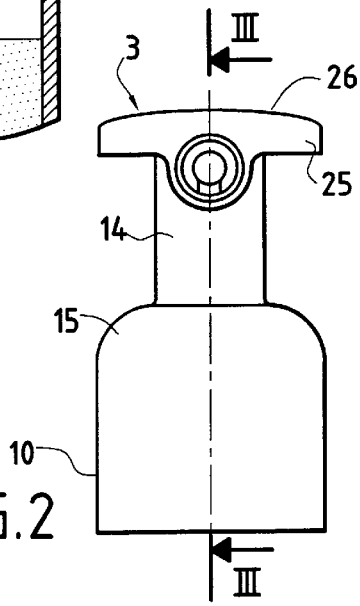
FIG. 2 is a side view of the pushbutton shown on its own, seen looking along arrow II in FIG. 1.

As can be seen in FIG. 2, the head 14 has an enlarged top end 25 defining a substantially plane bearing surface 26 extending perpendicularly to the axis X.

The elastically-deformable portion 15 does not come into contact with the fluid and it is generally dome-shaped, with the head 14 of the pushbutton 3 being connected to the elastically-deformable portion 15 at the top of the dome.

The elastically-deformable portion 15 is connected to the head 14 via an annular zone 30 of reduced thickness, but otherwise its thickness is substantially constant between said zone 30 of reduced thickness and the base 10.

Figure 3:
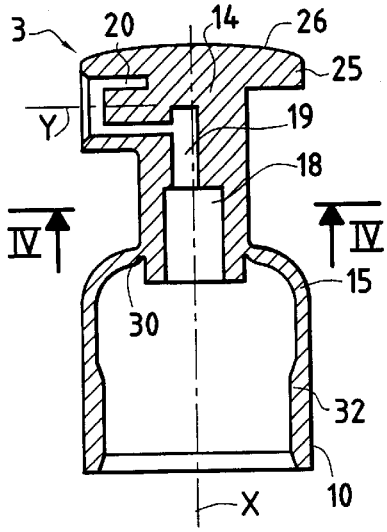
FIG. 3 is an axial section on section line III—III of FIG. 2.
Figure 4:
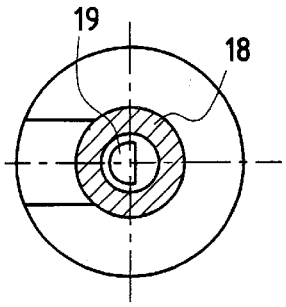
FIG. 4 is a cross-section on section line IV—IV of FIG. 3.

When the elastically-deformable portion 15 is seen in axial section as in FIG. 3, its shape is substantially that of one-fourth part of a circle on either side of the head 14.

This figure also shows that the elastically-deformable portion 15 connects to the head 14 in a direction that is substantially perpendicular to the axis X and that it connects to the base 10 parallel to the axis X.

In the embodiment described, the base 10 is in the form of a body of revolution with an annular bead 32 on its radially inner surface, said annular bead 32 being designed to increase the clamping force against the top portion 11 of the front body 17.

The bottom end of the base 10 is chamfered in its radially inner surface so as to make the pushbutton 3 easier to install on the pump body 17.

In the embodiment described, the outer surface of the elastically-deformable portion 15 and of the base 10 is continuous and does not present any portion in relief or any setback, thus leading to an appearance which is particularly pleasing.

Furthermore, the pushbutton 3 prevents any dirt from penetrating into the annular clearance 35 around the hollow rod 6.

In the embodiment described, the base 10, the elastically-deformable portion 15, and the head 14 are made as a single piece by injection molding using a material that has shape memory.

Materials that are suitable for use in making the pushbutton 3 include in particular mixtures based on ethylene vinyl acetate, thermoplastic elastomers, and low density polyethylene.

Naturally, the above list is not limited, and other suitable materials can be used, regardless of whether or not they are thermoplastic.

It will be observed that given the shape of the base 10 and of the elastically-deformable portion 15, the pushbutton can be made using a mold that is relatively simple.

To install the pushbutton 3, the base 10 is forced into position on the top end 11 of the pump body 17, the base 10 being suitable for expanding elastically in a radially-outward direction during such assembly.

Once in position, the base 10 is prevented from moving by friction on the top end of the pump body 17 by means of the clamping that results from using an elastomer material.

The pump 2 operates as follows, it being assumed that the pump is already primed.

To dispense a quantity of fluid P, the user depresses the head 14 along the axis X by pressing down on the bearing surface 26 with a finger.

Figure 5:
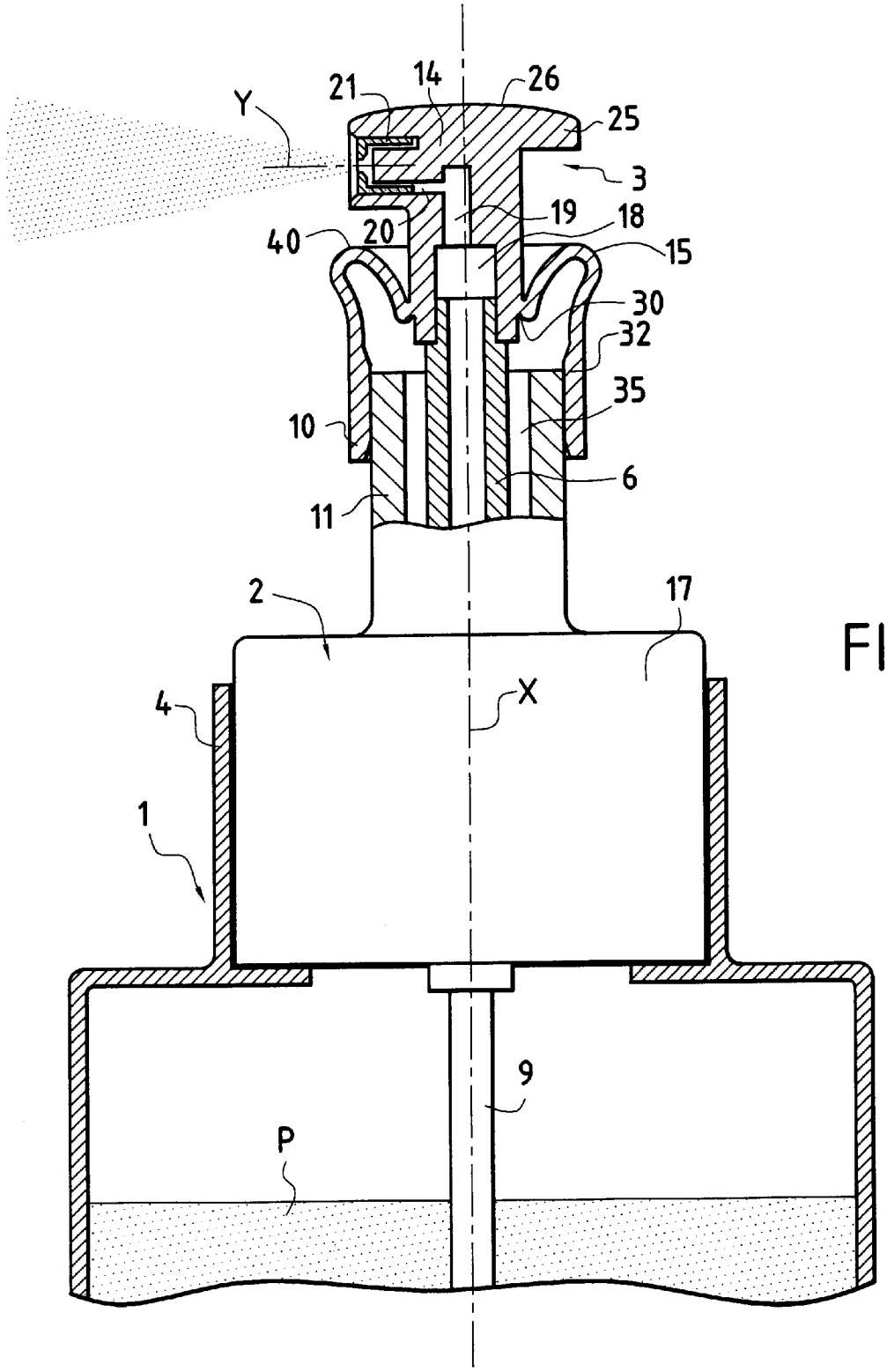
FIG. 5 is a view analogous to FIG. 1 showing the pushbutton while a quantity of fluid is being dispensed.

During this down stroke, the elastically-deformable portion 15 deforms so as to roll onto itself, as can be seen in FIG. 5.

It will be observed that after the head 14 has traveled along a certain distance of down stroke, the elastically-deformable portion forms a fold whose uppermost portion 40 is situated higher than the level where the head 14 connects with the elastically-deformable portion 15.

It will also be observed that the radial side of elastically-deformable portion 15 increases when the head 14 is pressed down.

The presence of the zone 30 of reduced thickness makes it easier to press down the head 14.

When the user releases the head 14 of the pushbutton 3, the elastic energy stored in the elastically-deformable portion 15 is released and by returning to its initial shape the elastically-deformable portion 15 returns the head 14 upwards, thereby enabling the hollow rod 6 to be raised and causing fluid to be sucked into the pump chamber in spite of the fact that there is no return spring in the pump body 17.

Naturally, the invention is not limited to the embodiment described above.

In particular, the shape of the elastically-deformable portion can be modified, e.g. by making cutouts therein, in which case it can be in the form of a slashed sleeve.

It is also possible to modify the shape of the base, and for example to make it integrally with a portion of the receptacle or of the pump body.

It is also possible to modify the shape of the head, and for example to make it integrally with the pump control rod.

It is also possible to make the pushbutton out of different materials, e.g. a rigid or semi-rigid plastics material for the base and for the head, and an elastomer material for the elastically-deformable portion, by using a dual injection technique with different thermoplastic materials, for example.

Finally, the invention makes it possible to provide a springless pump at a cost price that is relatively low, without any risk of corrosion as in a pump having a metal spring, that is easy to mold, and that is of an appearance that is more satisfactory than that of a pump that includes a spring-forming bellows.

What is claimed is:

1. A dispenser comprising:

a receptacle provided with a moving element that is movable between a position for dispensing a substance contained in the receptacle and a rest position, a pushbutton for actuating the moving element, said pushbutton having:

a base, a head defining both a bearing surface for a user and a dispensing orifice, said head being secured to said moving element, an elastically-deformable portion interconnecting said base and said head, wherein said elastically-deformable portion is arranged so as to deform in the sense of rolling onto itself when the head is depressed and is suitable for returning the moving element into an initial position by resilient return.

2. A dispenser according to claim 1, wherein the elastically-deformable portion is generally dome-shaped.

3. A dispenser according to claim 1, wherein the elastically-deformable portion is arranged to form a fold when the head is depressed, and wherein from at least a certain down stroke of the head, a zone in which the head is connected to the elastically-deformable portion passes beneath the level of the top of the fold.

4. A dispenser according to claim 1, wherein the head is situated in the center of the elastically-deformable portion.

5. A dispenser according to claim 1, wherein the elastically-deformable portion is of substantially constant thickness.

6. A dispenser according to claim 1, wherein the elastically-deformable portion has no folds when at rest.

7. A dispenser according to claim 1, wherein the base is tubular in shape, and is preferably circularly symmetrical.

8. A dispenser according to claim 1, wherein the head includes an endpiece enabling the head to be fixed onto a hollow rod.

9. A dispenser according to claim 8, wherein the endpiece is extended beneath a zone in which the elastically-deformable portion connects with the head.

10. A dispenser according to claim 1, wherein the head includes a housing enabling a nozzle to be secured thereto.

11. A dispenser according to claim 10, wherein the axis of the nozzle is perpendicular to the direction in which the head is depressed in order to dispense a quantity of fluid.

12. A dispenser according to claim 1, wherein the elastically-deformable portion is connected to the head substantially perpendicularly to the direction in which the head is depressed in order to dispense a quantity of fluid.

13. A dispenser according to claim 1, wherein the elastically-deformable portion is connected to the head via a zone of reduced thickness.

14. A dispenser according to claim 1, wherein the base is arranged to engage on a pump body.

15. A dispenser according to claim 14, wherein the base has an annular bead for engaging on the pump body.

16. A dispenser according to claim 1, wherein the thickness of the elastically-deformable portion lies in the range of 1 mm to 3 mm, and is preferably close to 2 mm.

17. A dispenser according to claim 1, wherein the head has an enlarged top end.

18. A dispenser according to claim 1, the pushbutton being made as a single piece by molding.

19. A dispenser according to claim 1, the pushbutton being made of a material having shape memory, and preferably selected from mixtures based on the following materials: ethylene vinyl acetate, thermoplastic elastomers, and low density polyethylene.

20. A pushbutton for actuating a moving element of a dispenser, said pushbutton having:

a base, a head defining both a bearing surface for a user and a dispensing orifice, said head being suitable for being secured to said moving element, an elastically-deformable portion interconnecting said base and said head, said elastically-deformable portion being arranged to form a fold having a top when the head is depressed, and connecting the head at a region of the head, wherein said region passes beneath the level of the top of the fold after a predetermined downward stroke of the head.

21. A pushbutton according to claim 20, wherein the elastically-deformable portion is generally dome-shaped.

22. A pushbutton according to claim 20, wherein the head is situated in the center of the elastically-deformable portion.

23. A pushbutton according to claim 20, wherein the elastically-deformable portion is of substantially constant thickness.

24. A pushbutton according to claim 20, wherein the elastically-deformable portion has no folds when at rest.

25. A pushbutton according to claim 20, wherein the base is tubular in shape, and is preferably circularly symmetrical.

26. A pushbutton according to claim 20, wherein the head includes an endpiece enabling the head to be fixed onto a hollow rod.

27. A pushbutton according to claim 26, wherein the endpiece is extended beneath a zone in which the elastically-deformable portion connects with the head.

28. A pushbutton according to claim 20, wherein the head includes a housing enabling a nozzle to be secured thereto.

29. A pushbutton according to claim 28, wherein the axis of the nozzle is perpendicular to the direction in which the head is depressed in order to dispense a quantity of fluid.

30. A pushbutton according to claim 20, wherein the elastically-deformable portion is connected to the head substantially perpendicularly to the direction in which the head is depressed in order to dispense a quantity of fluid.

31. A pushbutton according to claim 20, wherein the elastically-deformable portion is connected to the head via a zone of reduced thickness.

32. A pushbutton according to claim 20, wherein the base is arranged to engage on a pump body.

33. A pushbutton according to claim 32, wherein the base has an annular bead for engaging on the pump body.

34. A pushbutton according to claim 20, wherein the thickness of the elastically-deformable portion lies in the range 1 mm to 3 mm, and is preferably close to 2 mm.

35. A pushbutton according to claim 20, wherein the head has an enlarged top end.

36. A pushbutton according to claim 20, the pushbutton being made as a single piece by molding.

37. A pushbutton according to claim 36, the pushbutton being made of a material having shape memory, and preferably selected from mixtures based on the following materials: ethylene vinyl acetate, thermoplastic elastomers, and low density polyethylene.

38. A pump fitted with a pushbutton as defined in claim 20.

39. A receptacle fitted with a pump as defined in claim 38.

40. A pushbutton for actuating a moving element of a dispenser, said pushbutton having:

a base, a head defining both a bearing surface for a user and a dispensing orifice, said head being suitable for being secured to said moving element, an elastically-deformable portion interconnecting said base and said head, said elastically-deformable portion being connected to the head via a zone of reduced thickness, and being arranged so as to return the moving element into an initial position by resilient return.

41. A pushbutton according to claim 40, wherein said elastically-deformable portion is arranged so as to deform in the sense of rolling onto itself when the head is depressed.

42. A pushbutton according to claim 40, wherein the elastically-deformable portion is generally dome-shaped.

43. A pushbutton according to claim 40, wherein the elastically-deformable portion is arranged to form a fold when the head is depressed, and wherein from at least a certain down stroke of the head, the zone passes beneath the level of the top of the fold.

44. A pushbutton according to claim 40, wherein the head is situated in the center of the elastically-deformable portion.

45. A pushbutton according to claim 40, wherein the elastically-deformable portion is of substantially constant thickness.

46. A pushbutton according to claim 40, wherein the elastically-deformable portion has no folds when at rest.

47. A pushbutton according to claim 40, wherein the base is tubular in shape, and is preferably circularly symmetrical.

48. A pushbutton according to claim 40, wherein the head includes an endpiece enabling the head to be fixed onto a hollow rod.

49. A pushbutton according to claim 48, wherein the endpiece is extended beneath the level of the zone.

50. A pushbutton according to claim 40, wherein the head includes a housing enabling a nozzle to be secured thereto.

51. A pushbutton according to claim 40, wherein the axis of the nozzle is perpendicular to the direction in which the head is depressed in order to dispense a quantity of fluid.

52. A pushbutton according to claim 40, wherein the elastically-deformable portion is connected to the head substantially perpendicularly to the direction in which the head is depressed in order to dispense a quantity of fluid.

53. A pushbutton according to claim 40, wherein the base is arranged to engage on a pump body.

54. A pushbutton according to claim 53, wherein the base has an annular bead for engaging on the pump body.

55. A pushbutton according to claim 40, wherein the thickness of the elastically-deformable portion lies in the range 1 mm to 3 mm, and is preferably close to 2 mm.

56. A pushbutton according to claim 40, wherein the head has an enlarged top end.

57. A pushbutton according to claim 40, the pushbutton being made as a single piece by molding.

58. A pushbutton according to claim 57, the pushbutton being made of a material having shape memory, and preferably selected from mixtures based on the following materials: ethylene vinyl acetate, thermoplastic elastomers, and low density polyethylene.

59. A pump fitted with a pushbutton as defined in claim 40.

60. A receptacle fitted with a pump as defined in claim 59.

61. A pushbutton for actuating a moving-element of a dispenser, said pushbutton having:

a base, a head defining a bearing surface for a user, said head being suitable for being secured to said moving element, and including a center post and a ring groove enabling a nozzle, not made integral with the head, to be secured thereto, an elastically-deformable portion interconnecting said base and said head, and being integral with said base and said head, said elastically-deformable portion being arranged for returning the moving element into an initial position by resilient return.

62. A pushbutton according to claim 61, wherein said elastically-deformable portion is arranged so as to deform in the sense of rolling onto itself when the head is depressed.

63. A pushbutton according to claim 61, wherein the elastically-deformable portion is generally dome-shaped.

64. A pushbutton according to claim 61, wherein the elastically-deformable portion is arranged to form a fold when the head is depressed, and wherein from at least a certain down stroke of the head, a zone in which the head is connected to the elastically-deformable portion passes beneath the level of the top of the fold.

65. A pushbutton according to claim 61, wherein the head is situated in the center of the elastically-deformable portion.

66. A pushbutton according to claim 61, wherein the elastically-deformable portion is of substantially constant thickness.

67. A pushbutton according to claim 61, wherein the elastically-deformable portion has no folds when at rest.

68. A pushbutton according to claim 61, wherein the base is tubular in shape, and is preferably circularly symmetrical.

69. A pushbutton according to claim 61, wherein the head includes an endpiece enabling the head to be fixed onto a hollow rod.

70. A pushbutton according to claim 69, wherein the endpiece is extended beneath a zone in which the elastically-deformable portion connects with the head.

71. A pushbutton according to claim 61, wherein the axis of the nozzle is perpendicular to the direction in which the head is depressed in order to dispense a quantity of fluid.

72. A pushbutton according to claim 61, wherein the elastically-deformable portion is connected to the head substantially perpendicularly to the direction in which the head is depressed in order to dispense a quantity of fluid.

73. A pushbutton according to claim 61, wherein the elastically-deformable portion is connected to the head via a zone of reduced thickness.

74. A pushbutton according to claim 67, wherein the base is arranged to engage on a pump body.

75. A pushbutton according to claim 74, wherein the base has an annular based for engaging on the pump body.

76. A pushbutton according to claim 61, wherein the thickness of the elastically-deformable portion lies in the range 1 mm to 3 mm, and is preferably close to 2 mm.

77. A pushbutton according to claim 61, wherein the head has an enlarged top end.

78. A pushbutton according to claim 61, the pushbutton being made as a single piece by molding.

79. A pushbutton according to claim 78, the pushbutton being made of a material having shape memory, and preferably selected from mixtures based on the following materials: ethylene vinyl acetate, thermoplastic elastomers, and low density polyethylene.

80. A pump fitted with a pushbutton as defined in claim 61.

81. A receptacle fitted with a pump as defined in claim 80.

* * * * *